US011618662B2

(12) United States Patent
Clüsserath et al.

(10) Patent No.: US 11,618,662 B2
(45) Date of Patent: Apr. 4, 2023

(54) METHOD AND FILLING SYSTEM FOR FILLING CONTAINERS

(71) Applicant: KHS GmbH, Dortmund (DE)

(72) Inventors: Ludwig Clüsserath, Bad Kreuznach (DE); Jonathan Lorenz, Bad Kreuznach (DE); Jochen Ohrem, Mainz (DE)

(73) Assignee: KHS GmbH, Dortmund (DE)

( * ) Notice: Subject to any disclaimer, the term of this patent is extended or adjusted under 35 U.S.C. 154(b) by 150 days.

(21) Appl. No.: 17/283,133

(22) PCT Filed: Oct. 29, 2019

(86) PCT No.: PCT/EP2019/079493

§ 371 (c)(1),
(2) Date: Apr. 6, 2021

(87) PCT Pub. No.: WO2020/094460

PCT Pub. Date: May 14, 2020

(65) Prior Publication Data

US 2021/0387840 A1 Dec. 16, 2021

(30) Foreign Application Priority Data

Nov. 5, 2018 (DE) ..... 10 2018 127 513.7

(51) Int. Cl.

| | |
|---|---|
| ***B67C 3/28*** | (2006.01) |
| ***B67C 3/10*** | (2006.01) |
| ***B67C 3/12*** | (2006.01) |

(52) U.S. Cl.
CPC ..... *B67C 3/10* (2013.01); *B67C 3/12* (2013.01); *B67C 3/286* (2013.01)

(58) Field of Classification Search
CPC ..... B67C 3/286; B67C 3/12; B67C 3/10
See application file for complete search history.

(56) References Cited

U.S. PATENT DOCUMENTS

| | | | | |
|---|---|---|---|---|
| 3,877,358 | A * | 4/1975 | Karr | B01F 23/2363 261/DIG. 7 |
| 6,463,964 | B2 * | 10/2002 | Clusserath | B67C 3/065 141/63 |
| 9,133,004 | B2 * | 9/2015 | Clusserath | B67C 3/12 |
| 2018/0127252 | A1 | 5/2018 | Bulunmaz | |

FOREIGN PATENT DOCUMENTS

| | | |
|---|---|---|
| DE | 10 2017 104 313 A1 | 9/2018 |
| EP | 2746215 A1 | 6/2014 |

* cited by examiner

*Primary Examiner* — Jason K Niesz
(74) *Attorney, Agent, or Firm* — Occhiuti & Rohlicek LLP

(57) ABSTRACT

A filling method includes executing a pre-stressing phase, during which, at plural time intervals, gas is drawn from a gas space that lies above the filling material in a tank. The gas pre-stresses a container up to a second pressure that is below the pressure in the gas space. During a filling phase, a liquid valve opens to allow the filling material in the tank to enter into the container. This valve is above the level of the filling material, thus preventing gravity from driving the flow.

15 Claims, 3 Drawing Sheets

METHOD AND FILLING SYSTEM FOR FILLING CONTAINERS

RELATED APPLICATIONS

This is the national stage of international application PCT/EP2019/079493, which claims the benefit of the Nov. 5, 2018 priority date of German application 1021018127513.7, the contents of which are herein incorporated by reference.

FIELD OF INVENTION

The invention relates to a method for filling containers with a fluid filling material and a filling system.

BACKGROUND

In known filling machines for filling a container with a liquid filling-material, the container's mouth is sealed against a filling element so that the container's interior develops a pressure that differs from ambient pressure.

The filling material is generally in a ring tank on a rotor. The flow speed at which filling material enters the container depends primarily on the height difference between the level of filling material in the tank and that of the discharge opening through which it enters the container. It is therefore important to regulate the level of filling material in the tank accurately, as even minor variations in this height difference result in substantial changes in flow speed.

As liquid filling-material enters the container, it displaces gas. This displaced gas travels along a return gas path. To reduce the flow speed, it is known to have a choke along this return gas path.

In some cases, the filling material is a beverage in which a base liquid is flavored with various ingredients, often in the form of syrups, sugar, and other additives. This beverage is produced in a mixing system upstream of the filling tank on the rotor.

The finished beverage is stored in a storage tank of the mixing system. A pressure-boosting pump delivers this beverage into the partially-filled ring tank. From there, the beverage is delivered to filling elements on the rotor, which ultimately fill the containers. In such cases, pressure in the storage tank and in the ring tank are regulated independently of each other.

Disadvantageous with these known methods is, among other factors, is that the mixer or mixing system, in which the components forming the mixed beverage (water and/or sugar and/or base syrup and/or aroma substance and/or carbon dioxide) are mixed represent a unit which is both spatially and structurally separate from the filling machine, and that therefore connecting lines are necessary between the mixer and the filling machine, which represent a substantial costs factor. In addition to this pipe system, the filling material tank of the filling machine formed as an intermediate store also represents a substantial costs factor.

SUMMARY

Among the disadvantages is that the mixing system and the filling machine are spatially and structurally separate from each other. Therefore, connecting lines are needed between them. These lines represent extra cost. In addition, the ring tank on the filling machine, which is for intermediate storage of the filling material, is also costly.

The invention provides a filling system that fills containers with liquid filling-material but without the use of a tank for intermediate storage on the rotor that has a gas space above the filling material, such as the ring tank.

In this situation, the method according to the invention is intended to allow for a filling of the container with fluid filling material even if the filling material level of a liquid compartment of a filling material tank of a mixer is arranged lower than the closure plane of a filling valve assigned to it. Such an arrangement leads to what is referred to as a negative geodetic height.

a significant aspect of the present invention is that of a method for the filling of containers with a fluid filling material, making use of a filling system with which a discharge opening of a fluid valve of a filling element is located arranged at a height above a fill level of a liquid compartment of a filling material container of a mixer, with which the container which is in sealing contact with the filling element of the filling system is pre-stressed in a pre-stressing phase, at least at times, with a stressing gas under positive pressure, to a pre-stressing pressure, wherein the stressing gas is drawn from the gas compartment of the filling material container of the mixer, and, in a subsequent filling phase, with the fluid valve of the filling element open, is filled with the filling material from the liquid compartment of the filling container by way of a product line of the filling system, completely filled with the filling material, wherein, at least during the filling phase, the return gas which is displaced out of the container by the incoming filling material is conveyed away via a return gas path of the filling element into a collection channel, and wherein, in the container, during the pre-stressing phase, at least before the beginning of the following filling phase, a pre-stressing pressure is produced, which lies at a pressure level below the positive pressure of the gas compartment of the filling material container of the mixer.

According to the invention, in this situation it is possible to do without the intermediate store of the filling machine, and the elaborate pipework can also be avoided. Moreover, the mixing system and the filling machine can therefore be configured as a single process engineering unit, with which the units, which hitherto were independent of one another according to the prior art, no longer work entirely independently of one another. In this situation, functions which were previously duplicated (electrical and process engineering) are avoided, which, as a result, leads to the manufacturing costs of such systems being significantly reduced. Also reduced is the space requirement in a production system, which represents another significant advantage.

In some embodiments, at least a part of the stressing gas, at least at times during the pre-stressing phase, is conveyed into a collection channel which is standing under atmospheric pressure.

In other embodiments, the stressing gas, at least during the pre-stressing phase, is conveyed away, controlled and/or regulated over its flow path, into the collection channel under atmospheric pressure, and thereby an adjustable pressure difference is produced between the positive pressure of the gas compartment of the mixer and the pre-stressing pressure in the container.

In still other embodiments, the pre-stressing pressure in the container, at least during the pre-stressing phase, is controlled and/or regulated by a second regulating circuit in such a way that the following applies:

$$P_{STRESS}=P_{TANK}-P_{\Delta H1}-P_{FILLINGSPEED}-P_{FLOWLOSS}$$

where $P_{STRESS}$ is the pre-stressing pressure in the container, $P_{TANK}$ is the pressure of the gas in the gas compartment of the filling material container of the mixer, $P_{\Delta H1}$ is the negative pressure required for overcoming the height H1, $P_{FILLINGSPEED}$ is the negative pressure required to speed up the filling material at rest to the filling speed, and $P_{FLOWLOSS}$ is the negative pressure required to compensate for the pressure losses incurred by the flowing of the filling material.

According to another preferred embodiment variation, provision can be made for the return gas to be conducted away during the entire time period of the filling phase, by way of the flow path, into the ring channel which is under atmospheric pressure, and the filling pressure is regulated and/or controlled by the pressure difference also created during the filling phase between the positive pressure and the pre-stressing pressure by the second regulating circuit.

In this situation, by regulating circuits during the filling phase, a pressure difference is produced in the respective container which is sufficient to allow for an inflow of the filling material into the container. The filling speed which is determined by the pressure difference can be adjusted and/or regulated in this situation, for example, by two method variants.

In some embodiments, after the opening of the fluid valve, the gas connection into the stressing gas channel is closed. Immediately thereafter, a choked connection is opened into the unpressurized return gas channel. In this situation it is by the size of the choke opening that the outflowing gas quantity, and therefore the filling speed, can be determined and adjusted. With two filling speeds required, it is accordingly useful for there to be two control valves with corresponding choke sizes. In a further embodiment, the gas valve can also be configured as a regulating valve. In this situation, the filling speed is regulated in accordance with a profile that is predetermined for the beverage and for the container. In this situation, the easing of pressure after the end of the filling phase can also take place by way of the same choked gas path as that during the filling phase.

Still other embodiments include those in which a regulating valve is installed in the line of the product distribution channel that includes the flowmeter and the filling valve. In this situation, the regulating valve forms, together with the flowmeter, a further third regulating circuit for regulating the filling speed of the respective filling element. After the pre-stressing, a pressure difference prevails in the respective container, which is sufficient to ensure a flow in the direction of the respective container. The actual flow speed, in particular the filling speed, is in this case formed, after the opening of the fluid valve, by the third regulating circuit, in particular by way of its regulating valve and/or flowmeter. This embodiment has the advantage that the return gas can flow back again into the stressing channel and is therefore available for further use during the next filling.

In some embodiments, the filling speed is regulated during the filling phase by the second regulating circuit in such a way that, after the opening of the fluid valve, the gas connection into the ring channel, which is configured as a stressing channel, is closed by the first control valve, and immediately after this a choked connection into the unpressurized return gas channel is opened by the second control valve.

As an alternative or in addition, provision can also be made for the filling speed to be regulated during the filling phase by a third regulating circuit, which is comprised of a regulating valve, the flowmeter, and a third regulating and control device. In this situation, the third regulating circuit can regulate and/or control the filling speed during the filling phase, after the opening of the fluid valve, by the regulating valve and/or the flowmeter.

According to another preferred embodiment variant, provision can be made for the pre-stressing pressure in the container to be controlled and/or regulated during the pre-stressing phase and filling phase by the second regulating circuit.

According to another preferred embodiment variant, provision can be made that, during the filling phase, by a sustained discharge of the return gas into the ring channel which is under atmospheric pressure, a constant gas flow is produced out of the gas compartment of the filling material container in the direction of the container which is to be filled with fluid filling material, and thereby the prestressing pressure in the container is also regulated during the filling phase to a pressure level which is below the positive pressure of the gas compartment of the filling material container of the mixer.

According to another preferred embodiment variant, provision can be made that, by the second regulating circuit, the filling pressure under which the containers are filled with fluid filling material during the filling phase is guided such as to follow the pressure difference produced during the pre-stressing phase, down to the pre-stressing pressure.

According to another preferred embodiment variant, provision can be made for the gas compartment of the mixer to be subjected to a stressing gas which is under positive pressure, pressure-controlled by a first regulating circuit, configured as a pressure regulating circuit.

According to another preferred embodiment variant, provision can be made for the gas compartment of the mixer is regulated to a positive pressure, which is higher than the carbon dioxide saturation pressure of the fluid filling material which is present in the liquid compartment.

According to another preferred embodiment variant, provision can be made that the fluid filling material is delivered to the liquid compartment of the filling material container in a level-regulated manner, such that the height of the filling material level of fluid filling material in the liquid compartment is held constant or close to constant.

The expression "essentially" or "approximately" signifies in the meaning of the invention deviations from the exact value in each case by +/−10%, preferably by +/−5%, and/or deviations in the form of changes which are not of significance for the function.

Further embodiments, advantages, and possible applications of the invention are also derived from the following description of exemplary embodiments and from the Figures. In this context, all the features described and/or represented as figures are, individually or in any desired combination, in principle the object of the invention, regardless of their combination in the claims or reference to them. The contents of the claims are also deemed to be constituent parts of the description.

Although a number of aspects have been described in connection with a device, it is understood that these aspects also represent a description of the corresponding method, such that a block element or a structural element of a device is also to be understood as a corresponding method step or as a feature of a method step. By analogy with this, aspects which have been described in connection with a method step, or described as a method step, also represent a description of a corresponding block or detail or feature of a corresponding device. Some or all of the method steps can be carried out by a hardware apparatus (or by making use of a hardware apparatus), such as, for example, a microprocessor, a programmable computer, or an electronic circuit. With some exemplary embodiments, some or a plurality of the most important method steps can be carried out by such an apparatus.

BRIEF DESCRIPTION OF THE FIGURES

The invention is described in greater detail hereinafter on the basis of the figures, in which.

Identical reference numbers have been used in the figures for elements which are the same or have the same effect. Moreover, for the sake of easier overview, only reference numbers have been represented in the individual figures which are required for the description of the respective figure. The invention is also only represented in the figures as a schematic view to explain the mode of operation. In particular, the representations in the figures serve only to explain the underlying principle of the invention. For reasons of easier overview, the representation of all the constituent parts of the device has been waived.

DETAILED DESCRIPTION

Figure 1:
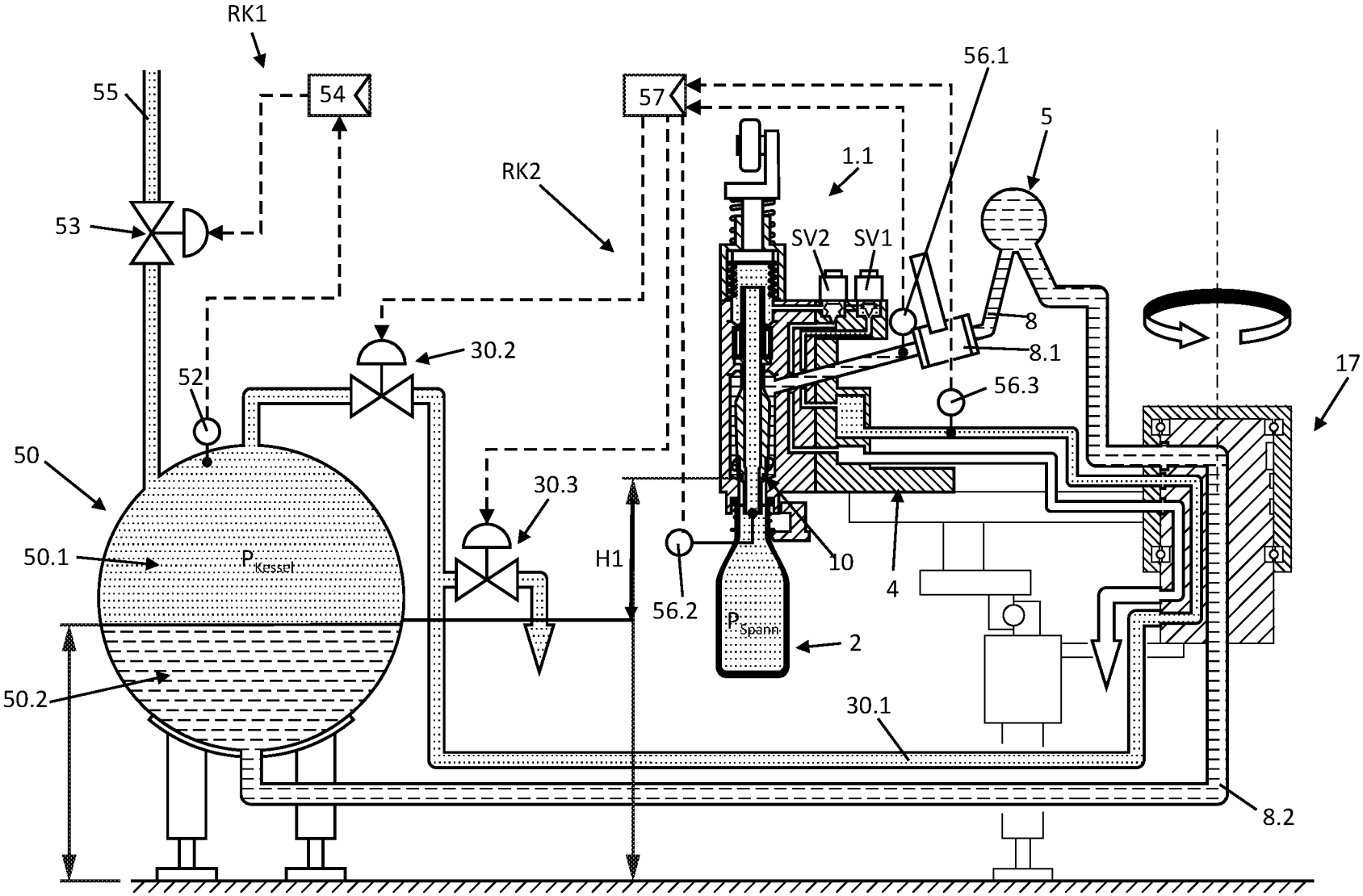
FIG. 1 a first embodiment of a filling system.
Figure 2:
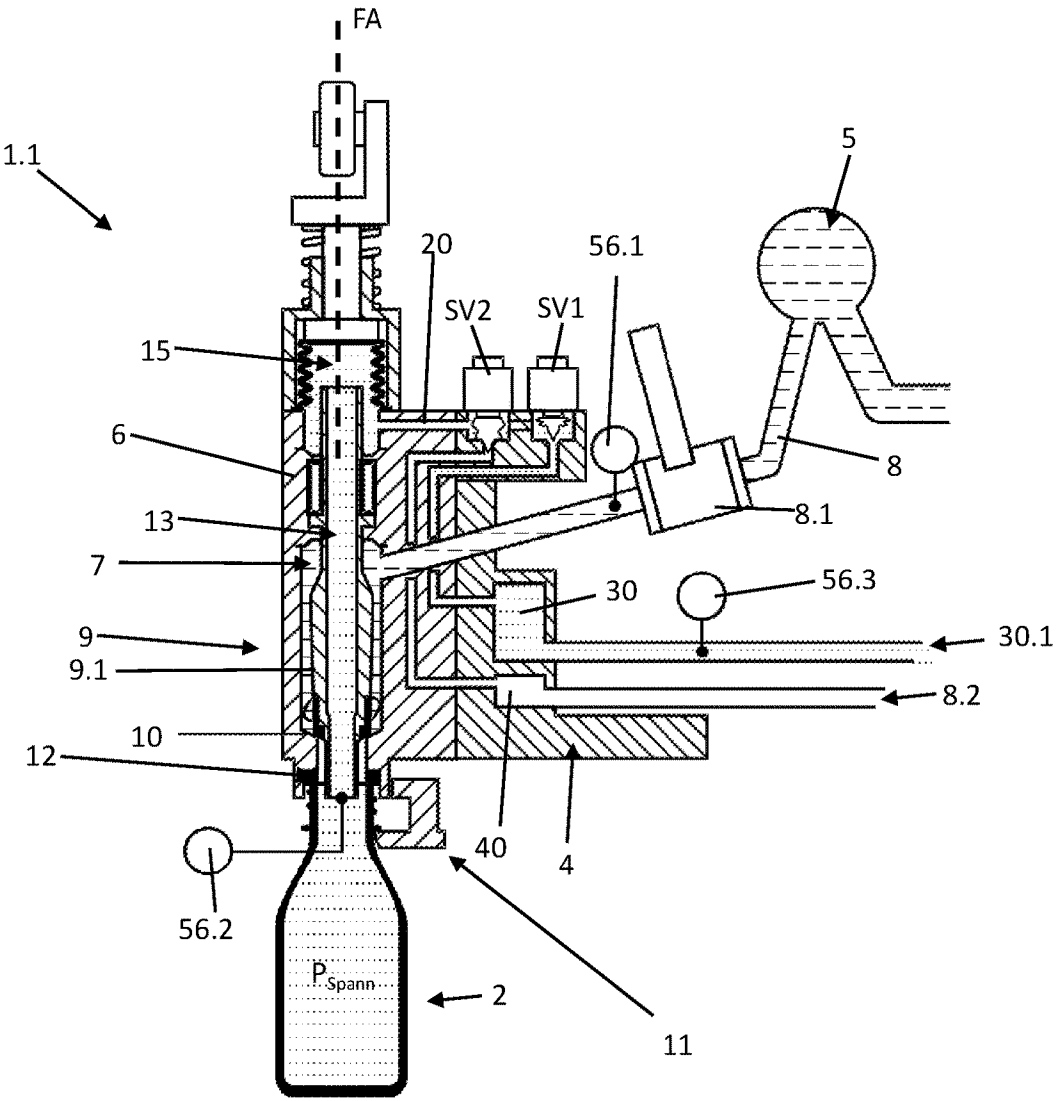
FIG. 2 shows details of the filling element shown in FIG. 1.

FIG. 1 shows a filling system 1 for a rotating filling machine that fills liquid filling-material into containers 2, such as bottles or cans, at filling elements 1.1, only one of which is shown in FIG. 1. The filling elements 1.1 are disposed at equal angles around a circumference of a rotor 4 that is driven around a vertical machine-axis MA.

A "mixer" is that part of a beverage-manufacturing system that degasses the base component, which is usually drinking water, and mixes it with a flavoring material, such as a syrup, until the syrup is at an appropriate concentration. If necessary, the beverage-manufacturing system also carbonates the beverage and buffers it with carbon dioxide gas.

The resulting beverage is then stored in a filling-material container 50, which is part of the filling system 1 shown in FIG. 1. The beverage, which is referred to herein as the "filling material," is then filled into containers 2 using the filling elements 1.1.

The filling-material container 50, which acts as a buffer reservoir or tank for buffering completed beverage, is quite large. A typical volume is as much as a thousand liters. The filling-material container 50 features a gas compartment 50.1 and a liquid compartment 50.2. The gas compartment 50.1 is pressurized with inert gas at a tank pressure $P_{TANK}$ that exceeds the carbon dioxide saturation beverage in the beverage.

The filling system 1 is configurable for free-jet filling, filling by way of the container wall, and/or long tube filling. In a preferred embodiment, the filling system 1 carries out pressure filling of the bottles 2. During the filling phase in which pressure filling takes place, a container 2 that is being filled is sealed against a filling element 1.1.

A product line 5 filled with the filling material extends along or through the rotor 4 to serve all its filling elements 1.1. Because the product line 5 is filled, there is no gas buffer above the liquid level in the product line 5. In a preferred embodiment, the product line 5 is a ring line.

In addition to the product line 5, the rotor 4 includes first and second ring-channels 30, 40 that, like the product line 5, are common to all the filling elements 1.1 of the filling machine. The first and second ring-channels 30, 40 carry out different functions depending on the filling process. During pressure filling, the first ring-channel 30 acts as a pre-stressing gas channel that conveys inert gas under positive pressure. In some embodiments, the second ring-channel 40 is a return gas or pressure relief channel for relieving the pressure on the containers 2. In such embodiments, the second ring-channel 40 is at atmospheric pressure.

The filling element 1.1 includes a housing 6 in which is formed a liquid channel 7. A liquid valve 9 along this liquid channel 7 controls discharge of filling material into the container 2 through a discharge opening at the filling element's underside. This discharge opening is preferably concentric with a filling-element axis FA and surrounded by a seal 12 against which the bottle's mouth 2.1 is pressed to make a seal during pressure filling. A neck ring holder 11 stabilizes the container 2 during the filling phase.

A connection line 8 connects the liquid channel 7 to the product line 5. A flowmeter 8.1 along the connection line 8 measures volume rate of flow of filling material conveyed by the connection line 8 to the liquid channel 7. In a preferred embodiment, the flowmeter 8.1 is a magnetic-inductive flowmeter.

The liquid valve 9 comprises a valve body 9.1, arranged in the liquid channel 7. The valve body 9.1 interacts with a valve seat formed on an inner surface of the liquid channel 7. The valve body 9.1 and valve seat form a closure plane for the liquid valve 9.

In the illustrated embodiment, the valve body 9.1 is provided at or forms a gas tube 13 that is coaxial with the filling-element axis FA. The gas tube 13, which is open at both ends, serves as a valve plunger for actuating the liquid valve 9. An actuator 14 interacts with the gas tube 13 to cause the valve body 9.1 to move axially along the filling-element axis FA, thereby opening and closing the liquid valve 9.

At its lower end, the gas tube 13 projects through the discharge opening and past the housing's underside. Therefore, during filling, the gas tube 13 extends into the bottle's interior. The tube's upper end extends into a closed gas compartment 15.

A flow path 20 in the filling element 1.1 connects to the bottle's interior via the gas compartment 15 and the gas tube 13. This places the bottle's interior in fluid communication with first and second control valves SV1, SV2 that control fluid communication between the bottle's interior and the first and/or second ring-channels 30, 40.

In some embodiments, the control valves SV1, SV2 have two states, namely "opened" and "closed." However, in other embodiments, the control valves SV1, SV2 are regulated to be in a multiple states between fully open and fully closed. The flow path 20 carries either gas or liquid. During a pre-stressing phase and/or a filling phase, the flow path 20 is in fluid communication with the bottle's interior.

In a preferred embodiment, the flow path 20 carries an inert gas into the container 2 at a pre-stressing pressure, $P_{STRESS}$. This is achieved by connecting the flow path 20 to the first ring-channel 30 using the first control valve SV1.

The flow path 20 also conveys away return gas that is displaced out of the container 2 during the filling phase. This is achieved by connecting the flow path 20 to the second ring-channel 40 using the second control valve SV2. The flow path 20 is thus configurable as a gas path and/or as a gas channel system.

A rotary connection 17 between the rotor 4 and a machine frame provides fluid communication between the second ring-channel 40 and the atmosphere. The first ring-channel 30 and the product line 5 connect via corresponding first and second connecting lines 8.1, 30.1 with the filling-material container 50, which is part of a mixer or mixing system that produces mixed products, such as carbonated beverages.

First and second control valves 30.2, 30.3, both of which are regulatable, are provided in the second connecting line 30.1 for controlling the flow of pre-stressing gas. The first control valve 30.2 forms a fluid-tight connection between the gas compartment 50.1 and the first ring-channel 30 using the second connecting line 30.1. A branch line connects the second connecting line 30.1 to the atmosphere. A third control valve 30.3 along this branch line opens to bring the second connecting line 30.1 to atmospheric pressure.

During pressure filling, the filling system 1 pre-stresses the container with gas drawn from the gas compartment 50.1. This gas is at the positive tank pressure $P_{TANK}$.

The filling system 1 comprises a first feedback-loop RK1, or "regulating circuit," that regulates the pressure in the filling-material container 50. The first feedback-loop RK1 comprises a pressure sensor 52 for detecting the pressure in the gas compartment 50.1, a regulatable control valve 53, and a first controller 54. The first feedback-loop RK1 regulates the gas, which is preferably carbon dioxide, that is conveyed via the gas line 55 into the gas compartment 50.1 from a separate gas source. This gas raises the gas compartment's internal pressure to a positive pressure $P_{TANK}$. This positive pressure $P_{TANK}$ is higher than the carbon dioxide saturation pressure of the mixing product present in the liquid compartment 50.2.

A separate supply line, which has been omitted for clarity, delivers liquid filling-material into the filling-material container 50 in a way that maintains the level of filling material to be constant or close to constant.

The closure plane of the liquid valve 9 of the filling element 1.1 is above the filling material level of the liquid compartment 50.2 of the mixer's filling-material container 50. This results in a negative height difference (H1) between the closure plane of the liquid valve 9 and the filling-material level of the liquid compartment 50.2.

Once the container 2 has been sealed against the filling element, a pre-stressing phase begins. During the pre-stressing phase, the container 2 is pre-stressed at time intervals with gas drawn from the gas compartment 50.1 of the filling-material container 50 of the mixing system. This gas is under the positive pressure $P_{TANK}$. During the pre-stressing phase, a pre-stressing pressure $P_{STRESS}$ is produced in the container 2. This pre-stressing pressure is below the pressure $P_{TANK}$ of the gas compartment 50.1.

In a subsequent filling phase, the liquid valve 9 opens and filling material from the liquid compartment 50.2 of the mixer's filling-material container 50 passes through the connection line 8, which becomes completely filled with the fluid filling material. This filling material enters the container 2 and displaces gas that is already in the container 2. The incoming filling material is drives this gas into the return gas path 20 of the filling element 1.1 and into the second ring-channel 40, which serves as a return gas channel.

The filling system 1 includes a second feedback-loop RK2 for regulating the pre-stressing pressure. The second feedback-loop RK2 includes first and second control valves 30.2, 30.3, a first sensor 56.1 and/or a second sensor 56.2 for detecting a filling pressure, and a third sensor 56.3 along the connecting line 30.1 between the second control valve 30.3 and the first ring-channel 30, for detecting the pre-stressing gas pressure. A second controller 57 controls operation of the control valves 30.2, 30.3 based on information provided by the sensors 56.1, 56.2, 56.3. During the pre-stressing phase, the second feedback-loop RK2 causes the pre-stressing pressure within the container 2 to be at a value $P_{STRESS}$ that is less than the positive pressure $P_{TANK}$ of the gas compartment 50.1.

In some practices, during the pre-stressing phase, there exist discrete time intervals during each of which a bolus of pre-stressing gas is conveyed away into the second ring-channel 40, which is under atmospheric pressure. In other practices, the pre-stressing gas is released during the entire duration of the pre-stressing phase into the second ring-channel 40.

In either case, the pre-stressing gas is conveyed away via the flow path 20 into the second ring-channel 40 in a controlled and/or regulated manner in such a way that an adjustable pressure difference DP is produced between the positive pressure $P_{TANK}$ of the gas compartment 50.1 and the pre-stressing pressure $P_{STRESS}$ in the container 2 during the pre-stressing phase. This pressure difference DF is regulated and/or controlled by the second feedback-loop RK2. In such cases, the pressure difference DF between the positive pressure $P_{TANK}$ of the gas compartment 50.1 and the pre-stressing pressure $P_{STRESS}$ in the container 2 is a reference pressure that the second controller 57 attempts to maintain using the second feedback-loop RK2.

The first and/or second sensors 56.1, 56.2 measure actual values of pressure. The second controller 57 interpolates these measured values toto regulate the pre-stressing pressure $P_{STRESS}$, which is given by the following relationship:

$$P_{STRESS}=P_{TANK}-P_{\Delta H1}-P_{FILLINGSPEED}-P_{FLOWLOSS}$$

In the foregoing relationship, $P_{TANK}$ is the positive pressure in the gas compartment 50.1, $P_{\Delta H1}$ is the negative pressure required to overcome the height differential H1, $P_{FILLINGSPEED}$ is a calculated negative pressure that would be required to accelerate filling material at rest up to the desired filling speed, and $P_{FLOWLOSS}$ corresponds to negative pressure required to compensate for the pressure losses incurred by the flow of the filling material. Since the filling capacity determines the flow speed of the filling material, and therefore also the flow losses, the flow losses are constantly changing.

To compensate for rapid changes in any of the foregoing parameters, the second feedback-loop RK2 engages in equally rapid dynamic guidance in an effort to maintain the pre-stress pressure at the correct value notwithstanding variations in those parameters. Of the parameters given, flow loss is typically the one that varies rapidly. A typical time interval for a dynamic adjustment of the guidance value of the second feedback-loop RK2 lies in the range between ten milliseconds and five hundred milliseconds. In a preferred embodiment, the second controller 57 makes necessary adjustments at intervals of between twenty milliseconds and two hundred milliseconds. In the course of this procedure, gas flows through the first and/or second control valves SV1, SV2 at a rate that corresponds to a filling speed of between fifty and four hundred meters per second.

In some embodiments, the second feedback-loop RK also regulates the filling pressure during the filling phase after the containers have been pre-stressed during the pre-stressing phase using gas drawn from the gas compartment 50.1. In this embodiment, any pre-stressing gas that remains in the container 2 as a result of the pre-stressing phase is displaced by the filling material that enters the container and is thus conveyed out of the container 2 via the flow path 20 into the second ring-channel 40, preferably during the entire duration of the filling phase. In this case, the second feedback-loop RK controls the pressure difference DF between the positive pressure $P_{TANK}$ and the pre-stressing pressure $P_{STRESS}$.

Preferably, the second feedback-loop RK regulates the pressure difference DF to attain a filling speed that corresponds to that which would have resulted from a water column of between three hundred and a thousand millimeters. This would correspond to a pressure of between 0.03 bar and 0.1 bar. The second feedback-loop RK2 thus maintains the pressure difference DF both during the pre-stressing phase and during the subsequent filling phase.

The second feedback-loop RK2, by controlling the pressure difference DF during the filling phase in the container 2, allows an inflow of the filling material into the container 2 and controls the filling speed into the container 2. The second feedback-loop RK2 thus adjusts the maximum possible filling speed during the filling phase.

In such embodiments, opening of the liquid valve 9 is followed by using the first control valve SV1 to close the gas connection into the first ring-channel 30, which in this case carries pre-stressing gas. Immediately thereafter, the second control valve SV2 forms a choked connection into the unpressurized return gas channel 40. The size of the choke opening formed by the second control valve SV2 controls outflowing gas quantity and therefore the filling speed using the second feedback-loop RK2. To provide two filling speeds required, it is useful to have two control valves SV1, SV2 with different choke sizes. The pressure relief after the end of the filling phase is then caused by the same choked gas path as that used during the filling phase.

Figure 3:
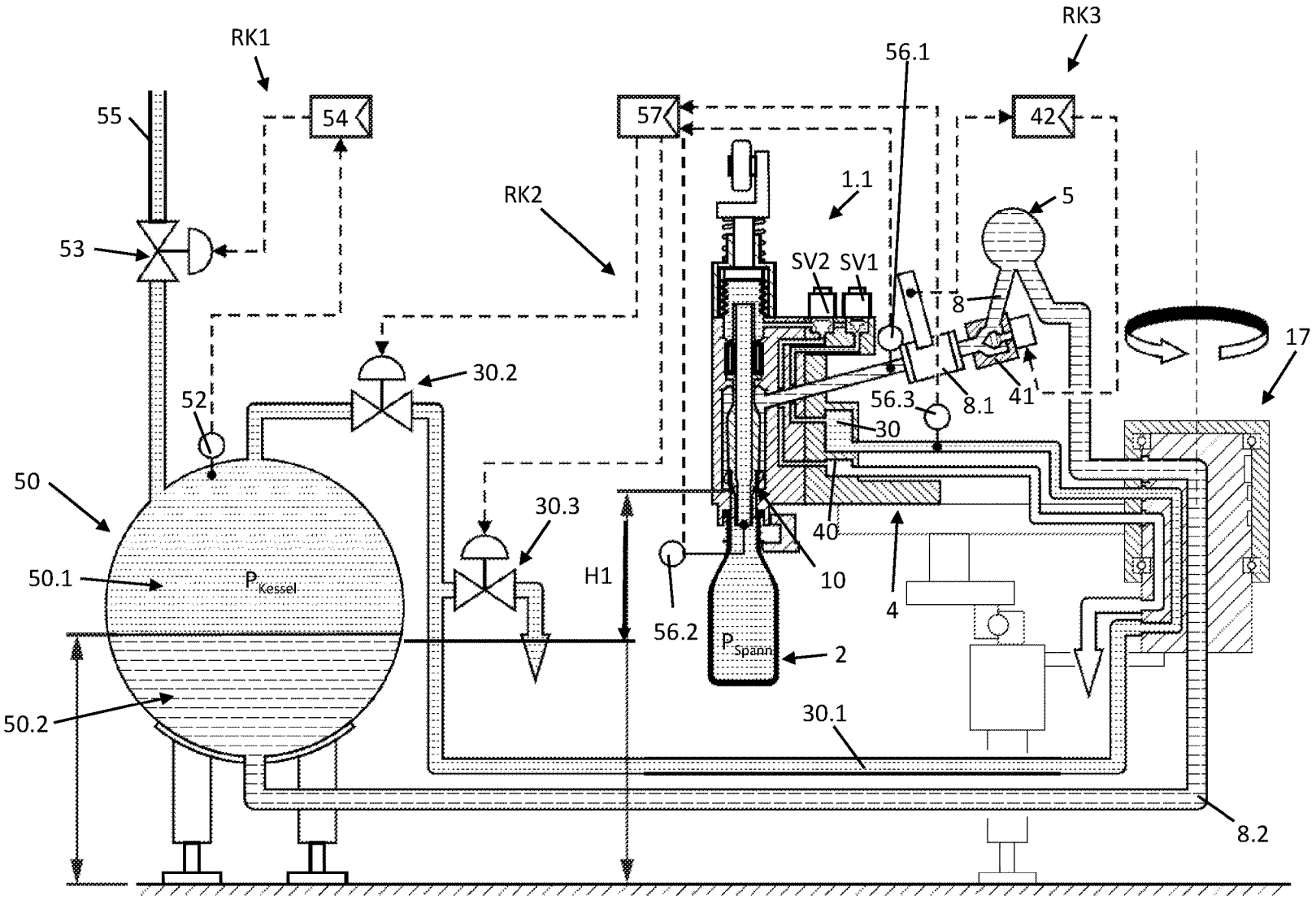
FIG. 3 shows a second embodiment of the filling system.

An alternative embodiment, shown in FIG. 3, features a third feedback loop RK3 that includes a regulating valve 41, a flowmeter 8.1, and a third controller 42. In this embodiment, the regulating valve 41 is one that is continuously adjustable and can therefore assume any intermediate position between being open and being closed. In some embodiments, the controller 42 is configured to designate intermediate settings as a stationary settings and to transition between them, thus causing the feedback loop RK3 to have a discrete rather than continuous manipulated variable.

The regulating valve 41 is installed in the connection line 8 of the product line 5 to the flowmeter 8.1, and specifically between the product line 5 and the flowmeter 8.1. The regulating valve 41 therefore forms, together with the flowmeter 8.1, the third regulating circuit RK3 for regulating and/or controlling the filling speed during the filling element's filling phase. After the pre-stressing, the pressure difference DZ prevails in the respective container 2. This is sufficient to ensure a flow in the direction of the container 2. By controlling the regulating valve 41 based on information from the flowmeter 8.1, it is possible for the third feedback loop RK3 to control the filling speed after the liquid valve 9 has been opened. In this embodiment, return gas can then flow back again into the ring channel and be made available for reuse when filling the next container 2.

In some embodiments, during the filling phase, the second feedback-loop RK2 produces a sustained flow of the return gas into the second ring-channel 40. This results in a constant flow of gas out of the gas compartment 50.1. This permits regulation of pressure in the container 50 during the filling phase so that it remains below the positive pressure $P_{TANK}$ of the gas compartment 50.1.

In other embodiments, the second feedback-loop RK2 provides a way to control the filling pressure used when filling the container 2 during the filling phase and to adjust the pressure difference DF produced during the prestressing phase to achieve the prestressing pressure $P_{STRESS}$.

The invention has been described heretofore by way of exemplary embodiments. It is understood that numerous modifications and derivations are possible, without thereby departing from the inventive concept underlying the invention.

In some embodiments, the product line 5 to only almost completely filled with the fluid filling material so that some gas is present therein. However, this is undesirable because gas is highly compressible. As a result, its volume may change significantly during pressure fluctuations. This would tend to have a negative effect on the filling process. It is therefore important for any such gas volume to be so small that the effect on the filling process will be negligible. For this to be the case, the volume of any such gas should be substantially smaller than that of the product line 5.

The invention claimed is:

1. A method comprising filling a container with a filling material using a filling system in which a closure plane of a liquid valve of a filling element is at a height that is above a filling-material level of in a filling-material container of a mixer, thereby resulting in a height differential, said filling-material container having a gas-filled volume that forms a gas compartment, which is filled with gas at first pressure, said first pressure being a positive gas-compartment pressure, and a liquid-filled volume that is filled with said filling material, said liquid-filled volume forming a liquid compartment, wherein filling said container comprises sealing said container at a sealing position of said filling element, executing a pre-stressing phase, and executing a filling phase, wherein executing said pre-stressing phase comprises, during plural time intervals, using a gas drawn from said gas compartment to pre-stress said container up to a second pressure, said second pressure being a pressure within said container, wherein, upon beginning execution of said filling phase, said second pressure lies below said first pressure and wherein executing said filling phase comprises opening said liquid valve, thereby filling said container with filling material from said liquid compartment via a product line of said filling system and conveying return gas into a collection channel, said return gas having been displaced from said container by said incoming filling material.

2. The method of claim 1, wherein executing said pre-stressing phase further comprises during each of a plurality of intervals, causing said gas to be conveyed away into a ring channel that is at atmospheric pressure.

3. The method of claim 1, wherein executing said pre-stressing phase further comprises regulating flow of said gas into a ring channel so as to control a pressure difference between said first pressure and said second pressure, wherein said ring channel is at atmospheric pressure.

4. The method of claim 1, wherein executing said pre-stressing phase comprises controlling said second pressure such that said second pressure is equal to said first pressure reduced by a sum of third, fourth, and fifth pressures, wherein said third pressure is a negative pressure required to overcome said height differential, wherein said fourth pressure is a negative pressure required to accelerate said filling material from rest to a desired filling speed, and said fifth pressure is a negative pressure required to compensate for the pressure losses incurred by flowing of said filling material.

5. The method of claim 1, wherein executing said filling phase comprises causing return gas to be conveyed away during the entire duration of said filling phase via a flow path into a ring channel and carrying out feedback control to regulate a filling pressure, wherein carrying out said feedback control comprises maintaining a pressure difference between said first pressure and said second pressure, wherein said ring channel is at atmospheric pressure.

6. The method of claim 1, further comprising using feedback control to control said second pressure during said pre-stressing phase and during said filling phase.

7. The method of claim 1, further comprising, during said filling phase, causing sustained conveyance of gas displaced from said container into a ring channel thereby causing a constant gas flow from the gas compartment in the direction of the container being filled and regulating said second pressure during said filling phase to be at a pressure that is below said gas-compartment pressure, wherein said ring channel is at atmospheric pressure.

8. The method of claim 1, further comprising using feedback control to regulate filling speed during said filling phase, wherein using said feedback control comprises, after having opened said liquid valve, using a first control valve to interrupt a fluid connection into a first ring-channel and, immediately thereafter, using a second control valve to open a choked connection into a second ring-channel, wherein said first ring channel carries said pre-stressing gas and wherein said second ring channel is unpressurized.

9. The method of claim 1, further comprising regulating filling speed during said filling phase, wherein regulating said filling speed comprises using a feedback loop that comprises a regulating valve, a flowmeter, and a controller that receives information from said flowmeter and uses said information to control said regulating valve.

10. The method of claim 1, further comprising, after having opened said liquid valve, controlling filling speed by using a regulating valve and a flowmeter.

11. The method of claim 1, further comprising using a feedback loop to exercise feedback control of filling pressure with which said container is filled during said filling phase and a pressure differential between said first and second pressures.

12. The method of claim 1, further comprising exercising feedback control over said first pressure using a pressure-regulating circuit.

13. The method of claim 1, further comprising regulating said first pressure such that said first pressure exceeds carbon-dioxide saturation pressure of said filling material in said liquid compartment.

14. The method of claim 1, further comprising causing flow of filling material into said filling-material container and regulating a level of filling material in said liquid compartment to maintain a constant level.

15. An apparatus for filling containers with liquid filling-material, said apparatus comprising a filling element comprising a filling valve having a closure plane, a filling element arranged at a height above a filling-material level of filling material in a filling-material container of a mixer, said apparatus being configured to seal a container at a sealing position of said filling element, to execute a pre-stressing phase, and to execute a filling phase, wherein executing said pre-stressing phase comprises, during plural time intervals, using a gas drawn from said gas compartment to pre-stress said container up to a pre-stressing pressure, wherein, upon beginning execution of said filling phase, said pre-stressing pressure lies below said positive pressure and wherein executing said filling phase comprises opening said valve, thereby filling said container with filling material from said liquid compartment via a product line of said filling system and conveying return gas into a collection channel, said return gas having been displaced from said container by said incoming filling material.

* * * * *